US006681508B2

(12) United States Patent
Unger et al.

(10) Patent No.: US 6,681,508 B2
(45) Date of Patent: Jan. 27, 2004

(54) VISUAL DISPLAY DEVICE

(75) Inventors: Darian Unger, Cambridge, MA (US); Adrian Gomez, Oakland, CA (US); David Tang, Somerville, MA (US); Stacy Bergman, Tulsa, OK (US); David Iannetta, Medford, MA (US); Lee Knight, Port Washington, NY (US); Aaron Bilstrom, Lake Oswego, OR (US); Renee A. Monteiro, Taunton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/097,461

(22) Filed: Mar. 14, 2002

(65) Prior Publication Data

US 2002/0174577 A1 Nov. 28, 2002

Related U.S. Application Data

(60) Provisional application No. 60/275,738, filed on Mar. 14, 2001.

(51) Int. Cl.[7] ..... G09F 19/00

(52) U.S. Cl. ..... 40/406; 40/409

(58) Field of Search ..... 40/406, 409; 446/267

(56) References Cited

U.S. PATENT DOCUMENTS

| | | | |
|---|---|---|---|
| ,685,110 | A | 10/1901 | Crouch |
| 1,533,738 | A | 4/1925 | Kane et al. |
| 1,856,098 | A | 5/1932 | Green |
| 1,979,336 | A | 11/1934 | Martin et al. |
| 2,054,275 | A | 9/1936 | Vellner |
| 2,072,841 | A | 3/1937 | Tracey et al. |
| 2,160,474 | A | 5/1939 | Jones et al. |
| 2,162,897 | A | 6/1939 | Rosenblatt |
| 2,182,570 | A | 12/1939 | Rosenblatt |
| 2,278,383 | A | 3/1942 | Rosenblatt |
| 2,378,934 | A | 6/1945 | Kloner |
| 2,412,171 | A | 12/1946 | Petry |
| 2,412,379 | A | 12/1946 | Abramson |
| 2,443,510 | A | 6/1948 | McCallum |
| 2,453,176 | A | 11/1948 | Abramson |
| 2,453,177 | A | 11/1948 | Abramson |
| 2,453,178 | A | 11/1948 | Abramson |
| 2,453,962 | A | 11/1948 | Barnett |
| 2,468,283 | A | 4/1949 | Abramson |
| 2,481,358 | A | 9/1949 | Smith |
| 2,520,691 | A | 8/1950 | Otis |

(List continued on next page.)

OTHER PUBLICATIONS

Fascinations, Go Go Geyser brochure cover page, sound activated liquid lamp for x–team visual effects, Jul. 27, 2001, Seattle, Washington.

*Primary Examiner*—Gary Hoge
(74) *Attorney, Agent, or Firm*—Daly, Crowley & Mofford, LLP

(57) ABSTRACT

A device for creating a visual display including a base, a container supported by the base and holding light transmitting liquids, and a light source disposed in the base, a pump mounted to the base and in fluid communication with the container; at least two immiscible liquids disposed in the container, the liquids having different densities; and a control circuit coupled to the pump to provide signals that cause the pump to inject a first one of the at least two immiscible liquids into a second one of the at least two liquids to produce a visual display.

21 Claims, 2 Drawing Sheets

U.S. PATENT DOCUMENTS 2,589,757 A 3/1952 Williams
2,818,770 A 1/1958 Cilurzo
2,877,051 A 3/1959 Cushman et al.
3,058,245 A 10/1962 Pieters
3,119,565 A 1/1964 Nottingham
3,151,811 A 10/1964 Hruby, Jr.
3,242,330 A 3/1966 Schoffer
3,387,396 A 6/1968 Smith
3,392,466 A 7/1968 LoGiudice
3,531,635 A 9/1970 Hancock
3,564,740 A 2/1971 Calfee
3,568,927 A 3/1971 Scurlock
3,570,156 A 3/1971 Walker
3,593,444 A 7/1971 Akrongold et al.
3,613,264 A 10/1971 Vitka et al.
3,629,958 A 12/1971 Olson et al.
3,686,494 A 8/1972 Naylor
3,711,698 A 1/1973 Hess
3,738,036 A 6/1973 Landsinger et al.
3,777,379 A 12/1973 Lewellen
3,783,036 A 1/1974 Ulrichsen
3,843,244 A 10/1974 Facchini
3,964,194 A 6/1976 Gugeler
3,973,340 A 8/1976 Khawand
4,023,289 A 5/1977 Crawford
4,034,493 A 7/1977 Ball
4,057,921 A 11/1977 Ball
4,070,777 A 1/1978 Lo Giudice
4,072,855 A 2/1978 Marchese
4,085,533 A 4/1978 Ewald
D248,632 S 7/1978 Gillespie et al.
4,170,035 A 10/1979 Walker
4,196,899 A 4/1980 Patterson
4,208,848 A 6/1980 Kohl
4,215,500 A 8/1980 Sharp
4,217,315 A 8/1980 Keeler, II
4,395,835 A 8/1983 Schneider
4,419,283 A 12/1983 Schneider
4,609,974 A 9/1986 Mori
4,686,784 A 8/1987 Smithies
4,715,136 A 12/1987 Fuller et al.
4,742,439 A 5/1988 Choate
4,749,126 A 6/1988 Kessener et al.
4,757,625 A 7/1988 Watkins
4,817,311 A 4/1989 Ong S. T.
4,858,083 A 8/1989 Wakimoto
4,901,922 A 2/1990 Kessener et al.
4,974,127 A 11/1990 Foley
4,985,811 A 1/1991 Weiner
5,006,375 A 4/1991 Mangan
5,018,288 A * 5/1991 Yang ..... 40/406
5,151,829 A 9/1992 Hwang
5,152,210 A 10/1992 Chen
5,160,086 A 11/1992 Kuykendal et al.
5,165,781 A 11/1992 Orak
5,272,604 A 12/1993 Lin
5,291,674 A 3/1994 Torrence
5,313,727 A 5/1994 Murray, Jr.
5,324,224 A 6/1994 Anderson et al.
5,416,994 A 5/1995 McLaughlin
5,426,877 A 6/1995 Lin
5,426,878 A 6/1995 Branson
5,430,629 A 7/1995 Belliveau et al.
5,442,869 A 8/1995 McDarren et al.
5,491,916 A 2/1996 Ingram et al.
5,617,657 A 4/1997 Kahn
5,678,918 A 10/1997 Lin
5,683,174 A 11/1997 Lena, Jr.
5,685,097 A 11/1997 Marinov
5,695,119 A 12/1997 Lien
5,706,594 A 1/1998 Lin
5,711,099 A 1/1998 Nesbit et al.
5,749,799 A 5/1998 Jasperson
5,791,078 A 8/1998 Maranto et al.
5,802,750 A 9/1998 Fulmer
5,803,580 A 9/1998 Tseng
5,816,884 A 10/1998 Chang
5,823,661 A 10/1998 Mahanay
5,862,984 A 1/1999 Chang
5,913,595 A 6/1999 Lin
5,938,318 A 8/1999 Mattsen
5,967,639 A 10/1999 Shih
5,979,091 A 11/1999 TenBrink
5,979,791 A 11/1999 Kuykendal et al.
6,006,461 A 12/1999 Snyder
6,015,216 A 1/2000 Nakamura
6,027,774 A 2/2000 Fine et al.
6,052,930 A 4/2000 Hermanson et al.
6,065,850 A 5/2000 Chiu
6,076,741 A 6/2000 Dandrel et al.
6,078,426 A 6/2000 Siegfried
6,135,604 A 10/2000 Lin
6,187,394 B1 2/2001 Johnson et al.
6,203,394 B1 3/2001 Lee
6,206,536 B1 3/2001 Lin
6,385,880 B1 * 5/2002 Naragon ..... 40/406
6,481,128 B1 * 11/2002 Lin ..... 40/406
2002/0069565 A1 * 6/2002 Liao ..... 40/406

* cited by examiner

VISUAL DISPLAY DEVICE

RELATED APPLICATIONS

This application claims priority of U.S. Provisional Application Ser. No. 60/275,738 filed on Mar. 14, 2001.

BACKGROUND OF THE INVENTION

1. Technical Field

The invention relates to decorative visual display devices.

2. Background Prior Art

Many types of visual display devices are known for providing different types of entertaining visual effects. For example, U.S. Pat. No. 6,135,604 discloses a decorative water lamp including a water container supported on a base. The base houses an air pump, a light emitter unit controlled by an electronic circuit board, and an audio speaker. An air tube extends from the pump outlet into the water container to send air into the water to produce a "shocked water current." The light emitter supplements the effect with visual color alterations, while the speaker provides audio accompaniment.

U.S. Pat. No. 3,843,244 discloses an apparatus for continuously transforming projected images. The apparatus includes a transparent container containing two differently colored, immiscible translucent liquids of different viscosity, density, and transparency. An external air pump injects a stream of air into the container to agitate the liquids so that a continuously changing visual display is produced by projecting light through the container.

U.S. Pat. No. 4,085,533 discloses a device for producing aesthetic effects using more than two immiscible liquids contained in a manner defining several layers or strata of liquids. As best shown in FIGS. 6–10, the device uses an external pump to continuously transport one of the liquids into a layer of another of the liquids. When the pumped liquid is released in the dissimilar liquid layer, a visual effect is created as the pumped liquid flows in a steady stream through the dissimilar layers to return to its own layer.

SUMMARY OF THE INVENTION

The present invention provides a device and method for creating new and different visual effects using two immiscible liquids. The general purpose of the invention is to beautify a room. In one embodiment, the invention also includes a light source so that the device can serve as a lamp to as aesthetically light a room.

In another embodiment, the invention provides a device including a light source, a pump, and a randomizing circuit inside the base. Above the base is a transparent container including two liquids that are immiscible and that have sufficiently different densities or specific gravities that the liquids form layers or strata with a defined interface between the layers. The pump is in fluid communication with the liquids and is operable to inject a portion of the lowest (most dense) liquid into the upper portion of the vessel containing the upper (less dense) strata of liquid. The pump operates to discharge a portion of the more dense liquid upwardly through the interface and then remains inactive for a period of time to afford settling of the more dense fluid into the lower region of the vessel.

In another embodiment, the invention provides a method for creating a visual display. In particular, the method includes the acts of: providing a vessel; providing first and second immiscible liquids of different densities in the vessel; and the act of pumping a portion of the first liquid into the second liquid such that a burst of the first liquid is observable in the second liquid. The act of pumping a portion of the first liquid into the second liquid can include providing a pump in fluid communication with the vessel and operating the pump intermittently to create intermittent bursts of the first liquid. The act of pumping a portion of the first liquid into the second liquid also can include pumping the first liquid in a substantially vertical direction into the second liquid.

Instead of pumping air into a container to agitate the immiscible liquids, and instead of continuously transporting one liquid into another to produce a relatively steady-stream return flow through one or more layers, the visual display device of the present invention pumps a first colored liquid from, and partially through, a first layer and directly into a second layer of transparent liquid having a substantially different density.

In another embodiment, the more dense liquid has a coloring agent and the less dense liquid is clear. A burst of colored liquid explodes into the transparent liquid and then gently and randomly falls, under the force of gravity, back into the layer of colored liquid to achieve an effect resembling a colored geyser or a magma eruption. The colored burst is preferably intermittent, and can be achieved using a pump that is preferably submerged directly in the colored liquid. An electronic circuit board controls the timing and intensity of the bursts by controlling the operation of the pump. Lighting and audio accompaniment are preferably provided to enhance the visual effect.

The present invention provides advantages to existing display devices. For example, the display device requires no warm-up time. Rather, it is operable immediately upon energizing the pump. Nor does the display heat to unsafe, hazardous or untouchable conditions.

Other features and advantages of the invention will become apparent to those skilled in the art upon review of the following detailed description, claims, and drawings.

Figure 1:
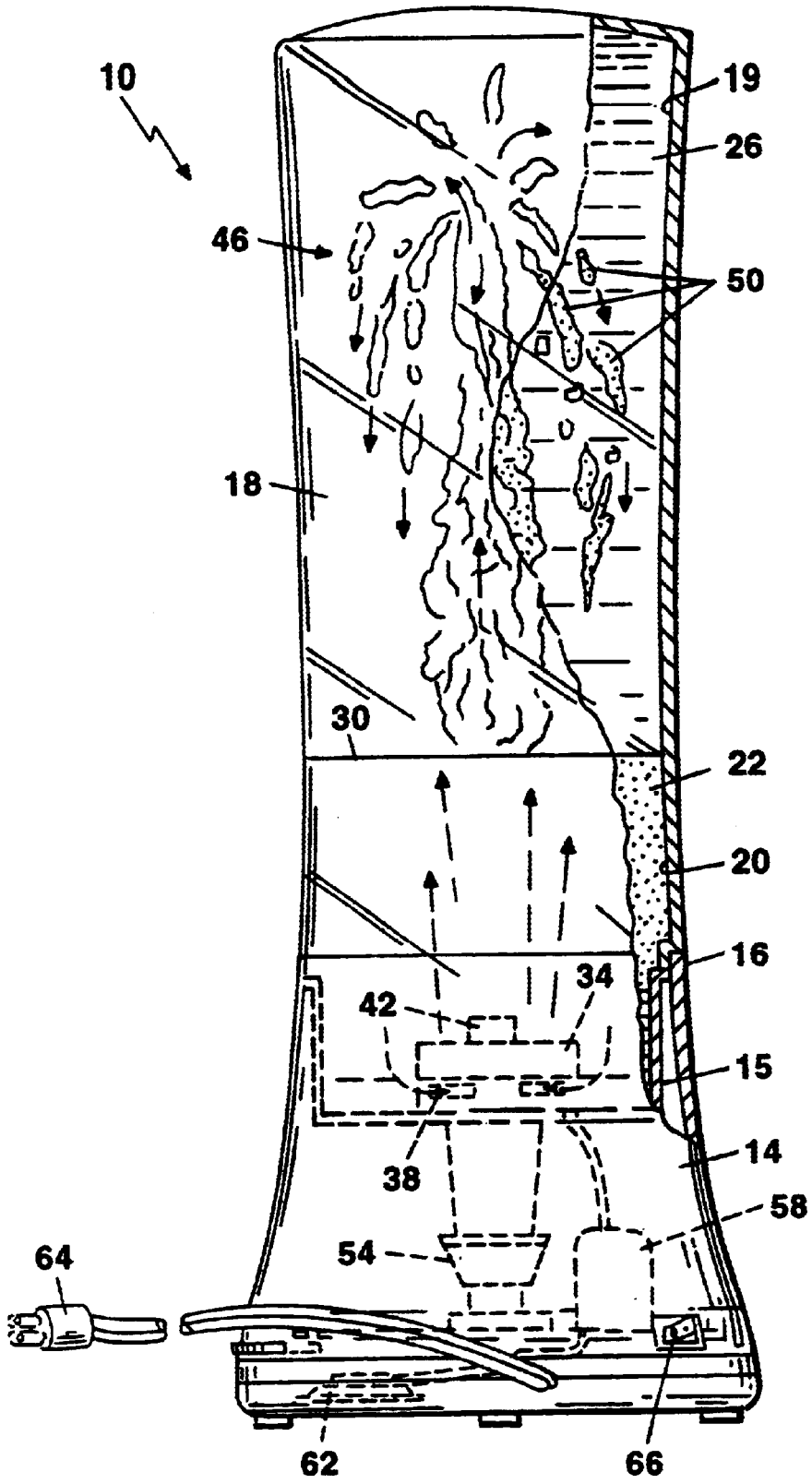
FIG. 1 is an elevational view, partially in section, of the display device embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a visual display device or lamp 10 embodying the invention. The device 10 includes a base 14 and a transparent container or vessel 18 mounted above the base 14. The vessel 18 is elongated so as to provide upper and lower portions 19, 20, and is hermetically sealed so as to contain fluids. The base 14 includes a seat 15 upon which the vessel 18 rests and a collar portion 16 that extends around the seat 15. The lower portion 20 of the vessel 18 extends, in part, below the seat 15 so that the collar 16 surrounds the lower end of the vessel 18.

The display device 10 also includes two or more immiscible fluids each having differing densities or specific gravities. While the device 10 could include three or more fluids, in the preferred embodiment the vessel 18 contains a first light-transmitting liquid 22 and a second light-transmitting liquid 26. The first and second liquids 22, 26 are immiscible with each other and preferably have densities or specific gravities of sufficient variation that one of the first and second liquids 22, 26 floats above the other of the first and second liquids 22, 26. As illustrated, the first liquid 22 has a density that is greater than the density of the second liquid 26 such that the first liquid 22 settles in the lower portion 20 of the container 18 and the second liquid 26 floats upon the first liquid 22. Two specific immiscible liquids of different densities that may be used in accordance with the present invention include water and vegetable oil, which appear to provide an inexpensive, safe and easy to handle combination of fluids.

The first and second liquids 22, 26 define therebetween a boundary or interface 30 where the first liquid 22 and the second liquid 26 separate from each other. It is preferred that the high density liquid (e.g. the first liquid 22 as illustrated) is or, is made to be, a relatively dark color whereas the low density liquid (e.g. the second liquid 26) is of a relatively light color. Various dyes and/or colorings may be used to provide suitable coloring to the liquids 22, 26 such as food coloring or anti-freeze. It will be readily apparent that one of the liquids may be clear or transparent.

The ratio of volume of the liquids 22, 26 can vary depending upon the particular configuration of the vessel 18 used and the desired effect. In one embodiment, a ratio of 4:6 is provided. While the preferred ratio of the liquids is in the range of about 13/16 or 40/60 it is important that the pump remains covered by the lower liquid during operation. However, the liquid ratios can vary within the scope of the invention in order to vary the effect of the visual display.

Among other considerations in choosing the ratio of liquids 22, 26 and, indirectly, the thicknesses of the strata of fluids 22, 26, is the desirability of obscuring the lower portion 20 of the vessel 18 and providing sufficient volume in the upper portion of the vessel 18 to permit dispersion of the portion of liquid 22 injected into the upper region 19 of the vessel 18.

The device 10 also includes a pump 34 mounted within the vessel 18. In particular, the pump 34 is fixed to the lower end of the vessel 18 in the lower portion 20 of the vessel adjacent the base 14. Preferably, the collar portion 16 of the base 14 extends sufficiently far up the lower portion 20 of the vessel to substantially obscure the pump 34. Also, the pump 34 is preferably obscured from view by the depth and coloring of the first liquid 22. One example of a suitable pump 34 is model number UT-85 available from United Pump Inc. of Ignacio Colo. The pump 34 includes an intake 38 and a nozzle 42 both of which are in fluid communication with the liquids 22, 26. The intake 38 and the nozzle 42 are positioned in the higher density liquid (e.g. the first liquid 22) near the bottom of container 18. During operation of the pump 34 (described in greater detail below), the first liquid 22 is drawn into the pump 34 through the intake 38 and then expelled from the pump 34 through the nozzle 42. The nozzle 42 is positioned and configured to create an upwardly flowing burst 46 of the first liquid 22 which travels through the lower portion 20 of the vessel 18, upwardly through the interface 30 and into the second liquid 26. In this regard, some of the first liquid 22 passes through and disrupts the boundary 30 and flows into the volume of second liquid 26. Because the liquids 22, 26 are immiscible and preferably are of different colors, the resulting burst 46 generates an aesthetically appealing visual effect.

While the particular shape of the burst 46 is for the most part uncontrollable, the burst 46 will generally take the form of several bulbous and amorphous blobs 50 of first liquid 22. The blobs 50 rise through the second liquid 26 after ejection from the pump 34, and fall back toward the first liquid 22 under the influence of gravity. The random shapes of the burst 46 combined with the coloring and amorphous nature of the individual blobs 50 and the defined interface between the liquids 22, 26 creates a visual effect that may resemble, for example, a volcanic eruption. Various other types of nozzles 42 may be used, including the use of multiple nozzles 42 to create a variety of visual display effects.

The device 10 also includes a light source 54 mounted within the base 14 to illuminate the first and second liquids 22, 26. In one embodiment, the light source 54 is a halogen bulb. A suitable halogen bulb that is widely available is a type MR16 or equivalent that operates on an input voltage of 12 VAC at 10 W. The light source 54 preferably shines light upwardly through the first and second liquids 22, 26 which, as mentioned above, are preferably at least partially light transmitting.

The device 10 further includes a randomizing circuit 58 that controls the duration and frequency of the pump 34 operation. The particular configuration and operation of the randomizing circuit 58 are such that the frequency and duration of the bursts 46 created by the pump 34 vary so as to appear to occur randomly. A number of suitable randomizing circuits 58 are available from American Control Products of Westbrook Conn. and may include features that allow for adjustments of the maximum and minimum values for on-time and off-time of the pump 34. Other, more sophisticated circuits 58 may include one or more motion detecting sensors that control the occurrence of the bursts 46 by sensing the presence of an observer. Such a more sophisticated circuit 58 is the VersaMax™ available from GE Fanuc Automation of Charlottesville, Va. The control circuit 58 should be adjustable (only to a degree so that the burst effect remains random) to vary the length of each pump-period (spurt) and the length of time between spurts (dwell). The length of each pump-period correlates with pump strength and exit speed/pressure, and should not be too short an interval because, for example, a spurt of only half-a-second does not afford the pump an opportunity to re-build a pressure head. However, a two-second spurt generates a sufficiently high fluid flow rate.

The maximum pump pressure occurs during a long spurt, during which the pump 34 achieves fall power and speed. Lower pump pressure is generally realized over random intervals ranging from zero, which is tantamount to a dwell when the pump is between spurts, to spurts shorter than maximum pump-periods.

Figure 2:
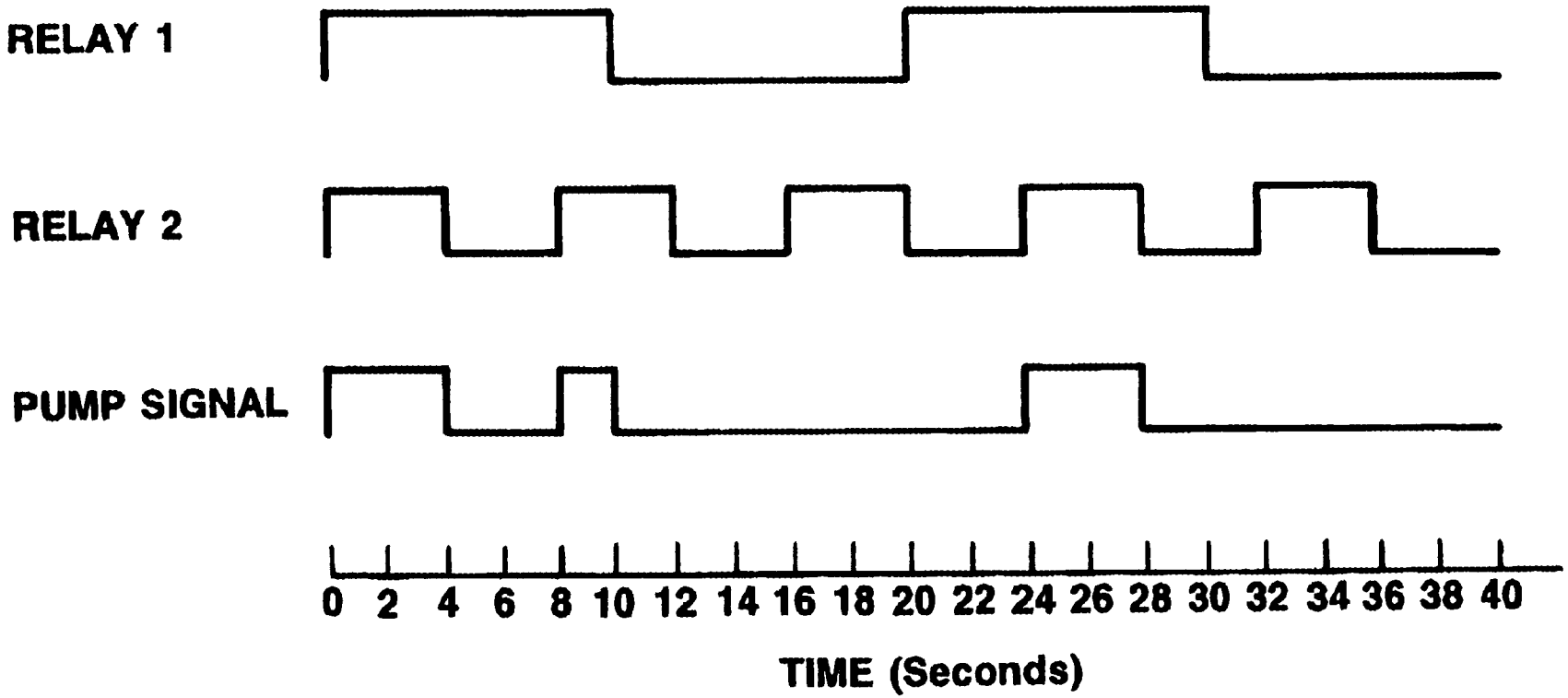
FIG. 2 is a schematic illustration of the operation of a randomizing circuit embodying the invention.

The randomizing circuit 58 preferably includes a series of 110VAC/60 Hz relays. The particular relays used are the SSAC brand model ASQA3 universal timing modules. The writing of the relays create a signal represented by FIG. 2, wherein, for example, one of the relays is open in regular 4 second intervals and another relay is open in regular 2 second intervals, the pump signal being generated when the relay signals are both open.

This signal gives a random effect to the observer due to the different liquid fluctuations caused by the pump. It will be readily recognized that the randomizing circuit could be accomplished using any suitable means, such as a cam relay with ten to twelve timed outputs and a reset such as those offered by Automatic Timing and Controls Company. This form of randomizing circuit could also be a relay implementation, but would result in an apparent random effect. Another form the randomizing circuit could take is a single integrated circuit (IC) such as the PCF8573 or PC8583 for Philips (with appropriate crystal, capacitors and resistors). Yet another possible form for the randomizing circuit would be a compact programmable logic controllers (PLC) such as the VersaMax developed by GE Fanuc Automation. This form of the randomizing circuit will produce a random effect and also afford the capability for other electrical applications such as sensing movement and reacting, playing music or allowing the owner to change the geyser effect's speed and timing.

The randomizing circuit 58 is adjustable to control the pump duty cycle. With the particular relays in use, the maximum possible on time would be nearly continuous and the minimum possible on time would be zero. There are infinitely many adjustments between the minimum and maximum 'spurt' time which could be considered in order to create an adjustment that is aesthetically pleasing. The randomizer 58 is adjustable to control (only to a slight degree to obtain the current random effect—adjustment is limited to minimum and maximum boundaries) the length of each pump-period (spurt) and the length of time between spurts. The length of each pump-period correlates with pump strength and exit speed/pressure. A very short spurt (i.e. two or less seconds) does not give the pump a chance to build up pressure. A longer spurt (i.e. more than two seconds) gets the fluid moving at a faster rate.

As mentioned above, the maximum pumping pressure occurs during a long spurt. During a long spurt, the pump achieves a full pressure head. Lower pressures are random based on time of spurt and built up head. These pressures range from zero when the pump is in between spurts to other random values lower than the maximum. Maximum pressure is selectable at the pump outlet by simply adjusting the diameter and character of the outlet. A suitable pump 34 has the following characteristics.

| Max Head | GPH@ outlet | 6" | 12" | 16" | 24" | 30" | 36" | 42" | 48" |
|---|---|---|---|---|---|---|---|---|---|
| 42" | 125 | 120 | 105 | 80 | 50 | 30 | 0 | 0 | 0 |

Pressure is only an issue as it pertains to breaking the liquid interface. Any pressure mechanism, such as a pump, air bellows or vibrator, could be used to create a aesthetically pleasing effect when one liquid breaks the interface between it and the other liquid.

Some embodiments of the invention may also include a sound emitting device 62. The sound emitting device 62 preferably includes a small speaker mounted within the base 14 and may be configured to provide a variety of sounds as desired. For example, the sound emitting device 62 may be configured to provide a sound that mimics that made by an erupting volcano, further enhancing the volcanic suggestion provided by the interaction between the first and second liquids 22, 26 as discussed above. The sound emitting device 62 may also be controlled by the randomizing circuit 58 such that sound is emitted simultaneously with the occurrence of a burst 46. Of course any type and duration of sound may be incorporated for use with the device 10 to achieve any desired auditory effect.

Several variations and modifications to the device 10 illustrated in FIG. 1 are possible while remaining within the spirit and scope of the present invention. For example the illustrated device 10 includes a wall plug 64 and a switch 66 that cooperate to selectively provide electrical power to the light source 54 and to the randomizing circuit 58, which in turn randomly supplies electrical power to the pump 34 and the sound emitting device 62. In this regard, the power cord which energizes the pump 34 passes through an opening (not shown) in the vessel 18. The opening and power cord are sealed to prevent leakage of liquids therethrough. It also should be appreciated however that other sources of electrical power including any type of battery, solar cells, and other sources of electricity may be utilized in connection with the present invention. Also, the illustrated device 10 includes two immiscible liquids, however the use of three or more immiscible liquids is possible to produce a similar aesthetically pleasing effect.

In addition, although the illustrated lamp shows the first liquid 22 occupying about 33% of the height of the container 18 with the second liquid 26 occupying the rest of the container 18, the relative amounts of the liquids 22, 26 can be varied to achieve whatever aesthetic effect is desired. It is highly preferable however for the densest liquid (e.g. the first liquid 22) to have sufficient depth and to be appropriately colored such that the pump 34 and nozzle 42 are completely covered and obscured by the first liquid 22.

In view of the foregoing, one of skill in the art will recognize that the invention also provides a method for creating a visual display. In particular, the method includes the acts of: providing a vessel; providing first and second immiscible liquids of different densities in the vessel; and the act of pumping a portion of the first liquid into the second liquid such that a burst of the first liquid is observable in the second liquid. The act of pumping a portion of the first liquid into the second liquid can include providing a pump in fluid communication with the vessel and operating the pump intermittently to create intermittent bursts of the first liquid. The act of pumping a portion of the first liquid into the second liquid also can include pumping the first liquid in a substantially vertical direction into the second liquid.

The method also includes the act of providing a light source and directing light into the vessel during pumping, and the act of emitting sound adjacent the vessel during the act of pumping.

Various features of the invention are set forth in the following claims.

What is claimed is:

1. Apparatus for creating a visual display comprising a base, a container disposed over the base and holding light transmitting liquids, and a light source disposed in the base, wherein the improvement comprises:

a pump mounted to the base and in fluid communication with the container;

at least two immiscible liquids disposed in the container, the liquids having different densities and wherein the liquids define therebetween a boundary where a first liquid meets a second liquid; and a control circuit coupled to the pump, the control circuit including a randomizing circuit to provide signals that cause the pump to inject a first one of at least two immiscible liquids into a second one of the at least two liquids to generate display effects.

2. The apparatus according to claim 1, wherein a first one of the at least two immiscible liquids has a density which is higher than the density of a second one of the at least two immiscible liquids.

3. The apparatus according to claim 2, wherein the higher density liquid and the lower density liquid have different colors.

4. The apparatus according to claim 1, wherein the display effects occur at a substantially random frequency and include a random time duration that are pseudo-random.

5. The apparatus according to claim 2, wherein the at least two liquids are photoluminescent.

6. The apparatus according to claim 1, wherein the base has a portion surrounding and substantially hiding the pump from view.

7. The apparatus according to claim 1, wherein the pump includes at least one-nozzle through which the first one of the liquids is discharged.

8. The apparatus according to claim 1, further comprising a sound emitting device configured to emit sound as the pump injects the first one of the at least two immiscible liquids into the second one of the at least two liquids.

9. An apparatus for creating a visual display comprising a base, a container disposed over the base for holding light transmitting liquids, and a light source disposed in the base, wherein the improvement comprises:

a pump mounted to the base and in fluid communication with the container;

at least two immiscible liquids disposed in the container, the liquids having different densities wherein the volume of each of the at least two immiscible liquids and the shape of the container form at least one visible boundary layer defined by two of the at least two immiscible liquids; and a control circuit coupled to the pump, the control circuit including a randomizing circuit to provide signals which cause the pump to inject a first one of the at least two immiscible liquids into a second one of the at least two liquids at a controlled pressure and volume to produce visual effects when the first one of the at least two immiscible liquids crosses the at least one visible boundary layer.

10. The apparatus according to claim 9, wherein the first one of the at least two immiscible liquids has a density which is higher than the density of the second one of the at least two immiscible liquids.

11. The apparatus according to claim 9, wherein the first and second ones of the at least two immiscible liquids have different colors.

12. The apparatus according to claim 9, wherein the control circuit includes a randomizing circuit that randomly signals the pump to inject the first liquid across the boundary and into the second liquid to generate the visual effects.

13. The apparatus according to claim 12, wherein the visual effects occur at a substantially random frequency and include a substantially random time duration.

14. The apparatus according to claim 9, wherein the at least two liquids are photoluminescent.

15. The apparatus according to claim 9, wherein the pump includes at least one nozzle through which the first one of the liquids is pumped.

16. The apparatus according to claim 9, further comprising a sound emitting device configures to emit sound as the pump injects the first one of the liquids into the second one of the liquids.

17. A method of providing a visual effect, the method comprising the acts of: providing a vessel; providing first and second immiscible liquids of different densities in the vessel, the liquids defining therebetween a boundary where the first liquid meets the second liquid; and the act of pumping at randomly selected times a portion of the first liquid into the second liquid such that a burst of the first liquid is observable in the second liquid.

18. The method of claim 17 wherein the act of pumping a portion of the first liquid into the second liquid includes providing a pump in fluid communication with the vessel and operating the pump intermittently to create intermittent bursts of the first liquid.

19. The method of claim 17 wherein pumping a portion of the first liquid into the second liquid includes pumping the first liquid in a substantially vertical direction into the second liquid.

20. The method of claim 17, further comprising the act of providing a light source for directing light into the vessel during pumping.

21. The method of claim 17, further comprising the act of emitting sound adjacent the vessel during the act of pumping.

* * * * *

UNITED STATES PATENT AND TRADEMARK OFFICE

CERTIFICATE OF CORRECTION

PATENT NO. : 6,681,508 B2
DATED : January 27, 2004
INVENTOR(S) : Darian Unger et al.

It is certified that error appears in the above-identified patent and that said Letters Patent is hereby corrected as shown below:

Column 1,
Line 13, reads “configures” and should read -- configured --.
Line 49, reads “to as” and should read -- to --.

Column 3,
Line 59, reads “lgnacio” and should read -- Ignacio, --.

Column 4,
Line 37, reads “Westbrook” and should read -- Westbrook, --.
Line 58, reads “fall” and should read -- full --.

Column 5,
Line 13, reads “controllers” and should read -- controller --.
Line 55, reads “a aesthetically” and should read -- an aesthetically --.

Column 7,
Line 17, reads “one-” and should read -- one --.

Signed and Sealed this

Tenth Day of August, 2004

JON W. DUDAS
*Acting Director of the United States Patent and Trademark Office*